US008535090B2

(12) United States Patent
Su et al.

(10) Patent No.: US 8,535,090 B2
(45) Date of Patent: Sep. 17, 2013

(54) CABLE CONNECTOR FOR CONNECTING MOTHERBOARD AND HARD DISK DRIVE

(75) Inventors: Xiao Su, Shenzhen (CN); Xian-Kui Chen, Shenzhen (CN); Hai-Li Wang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 16 days.

(21) Appl. No.: 13/221,869

(22) Filed: Aug. 30, 2011

(65) Prior Publication Data

US 2013/0014989 A1 Jan. 17, 2013

(30) Foreign Application Priority Data

Jul. 15, 2011 (CN) ..... 2011 1 0198346

(51) Int. Cl.
*H01R 11/00* (2006.01)

(52) U.S. Cl.
USPC ..... 439/502; 439/623

(58) Field of Classification Search
USPC ..... 439/502, 623; 174/72 A
See application file for complete search history.

(56) References Cited

U.S. PATENT DOCUMENTS

| | | | | |
|---|---|---|---|---|
| 4,280,062 | A * | 7/1981 | Miller et al. | 315/82 |
| 4,981,438 | A * | 1/1991 | Bekhiet | 439/76.1 |
| 5,698,821 | A * | 12/1997 | Herman | 174/72 R |
| 5,829,129 | A * | 11/1998 | Ito | 29/857 |
| 6,106,328 | A * | 8/2000 | O'Neal | 439/503 |
| 6,283,789 | B1 * | 9/2001 | Tsai | 439/502 |
| 6,439,923 | B1 * | 8/2002 | Kirkendall et al. | 439/502 |
| 7,182,630 | B1 * | 2/2007 | Su | 439/502 |
| 7,751,206 | B2 * | 7/2010 | Kosacek et al. | 361/826 |
| 7,871,293 | B1 * | 1/2011 | Chung | 439/502 |
| 8,308,507 | B2 * | 11/2012 | Lin | 439/502 |
| 8,314,603 | B2 * | 11/2012 | Russell | 324/66 |

* cited by examiner

*Primary Examiner* — Thanh Tam Le
(74) *Attorney, Agent, or Firm* — Altis Law Group, Inc.

(57) ABSTRACT

A cable connector includes four first male connectors of a first type, a second male connector of a second type, and four third male connectors of the first type. The first male connectors compose a first input/output terminal. The second male connector and the four third male connectors compose a second input/output terminal. Each first male connector is electrically connected to the second male connector and a corresponding third male connector.

9 Claims, 2 Drawing Sheets

CABLE CONNECTOR FOR CONNECTING MOTHERBOARD AND HARD DISK DRIVE

BACKGROUND

1. Technical Field

The present disclosure relates to cable connectors and, particularly, to a cable connector for connecting a hard disk drive (HDD) to a motherboard.

2. Description of Related Art

A cable connector for connecting an HDD to a motherboard usually includes two male connectors and a cable connected between the two male connectors. In use, one of the male connectors is connected to the motherboard and the other is connected to the HDD. The two male connectors are usually the same type of connectors, for example, the two male connectors may both be serial advanced technology attachment (SATA) connectors or serial attached small computer systems interface (SAS) connectors. Therefore, both the motherboard and the HDD must have compatible female connectors as there is no cross compatibility. The cable connector cannot be used when the motherboard and the HDD do not have the same type of female connectors.

Therefore, it is desirable to provide a cable connector, which can overcome the above-mentioned limitations.

BRIEF DESCRIPTION OF THE DRAWINGS

Many aspects of the disclosures should be better understood with reference to the following drawings. The components in the drawings are not necessarily drawn to scale, the emphasis instead being placed upon clearly illustrating the principles of the present disclosure.

DETAILED DESCRIPTION

Figure 1:
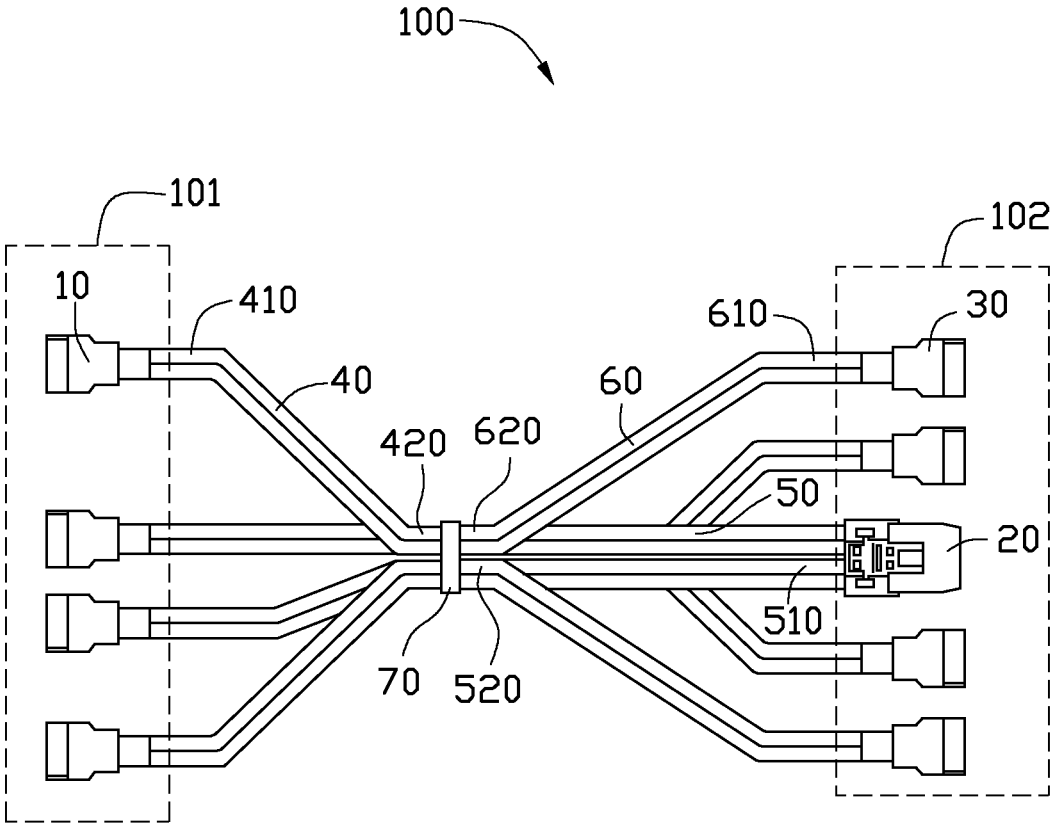
FIG. 1 is a schematic view of a cable connector, according to an exemplary embodiment.

Referring to FIG. 1, a cable connector 100 includes four first male connectors 10, a second male connector 20, four third male connectors 30, four first cables 40, four second cables 50, four third cables 60, and a binding member 70.

The first male connectors 10 compose a first input/output terminal 101 of the cable connector 100. In an exemplary embodiment, each first male connector 10 is an SATA male connector.

The second male connector 20 and third male connectors 30 compose a second input/output terminal 102. In an exemplary embodiment, the second male connector 20 is an SAS male connector. Each third male connector 30 is an SATA male connector.

Each first cable 40 includes a first connection end 410 and a second connection end 420. Each first connection end 410 is connected to a first male connector 10.

Each second cable 50 includes a third connection end 510 and a fourth connection end 520. Each third connection end 510 is connected to the second male connector 20. Each fourth connection end 520 is connected to a corresponding second connection end 420. Each first cable 40 is connected to a corresponding second cable 50.

Each third cable 60 includes a fifth connection end 610 and a sixth connection end 620. Each fifth connection end 610 is connected to a corresponding third male connector 30. Each sixth connection end 620 is connected to a corresponding second end 420. Each third cable 60 is connected to a corresponding second cable 50.

The binding member 70 is made of insulative material, such as plastic or rubber. The binding member 70 binds the first cables 40, the second cables 50, and the third cables 60 together. The first input/output terminal 101 and the second input/output terminal 102 are respectively positioned at two sides of the binding member 70.

Figure 2:
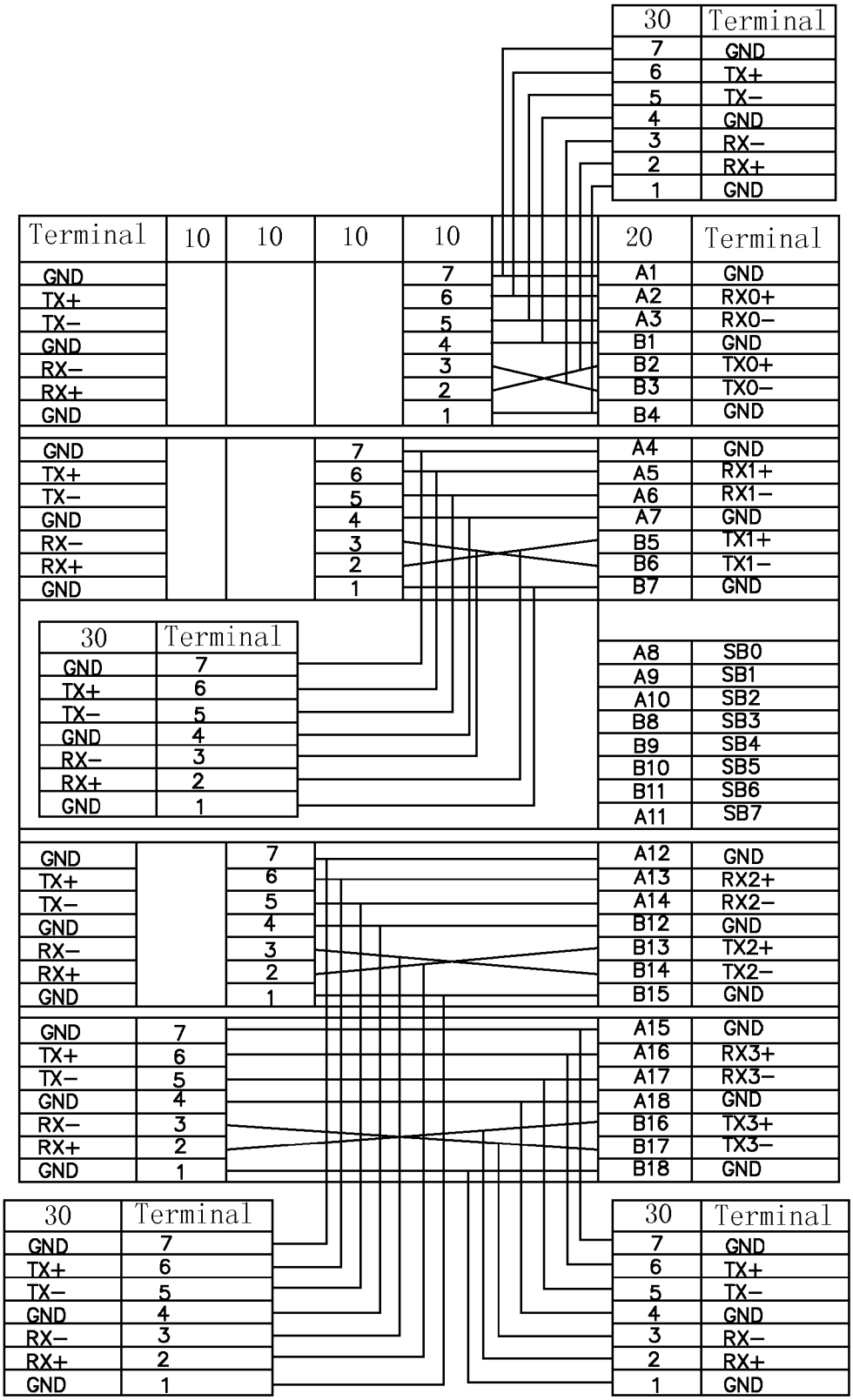
FIG. 2 is circuit diagram of the cable connector of FIG. 1.

Referring to FIG. 2, each first male connector 10 includes seven terminals 1-7. The terminals 1-7 are GND, RX+, RX−, GND, TX−, TX+, and GND. The second male connector 20 includes thirty six terminals A1-A18 and B1-B18. Each third male connector 30 is the same as the first male connector 10 and includes seven terminals 1-7 which are GND, RX+, RX−, GND, TX−, TX+, and GND.

The terminals GND, RX+, RX−, GND, TX−, TX+, and GND of a first one of the first male connectors 10 are respectively connected to the terminals B4, B2, B3, B1, A3, A2, and A1 of the second male connector 20. The terminals GND, RX+, RX−, GND, TX−, TX+, and GND of a second one of the first male connectors 10 are respectively connected to the terminals B7, B5, B6, A7, A6, A5, and A4 of the second male connector 20. The terminals GND, RX+, RX−, GND, TX−, TX+, and GND of a third one of the first male connectors 10 are respectively connected to the terminals B15, B13, B14, B12, A14, A13, and A12 of the second male connector 20. The terminals GND, RX+, RX−, GND, TX−, TX+, and GND of a fourth one of the first male connectors 10 are respectively connected to the terminals B18, B16, B17, B18, A17, A16, and A15 of the second male connector 20.

The terminals GND, RX+, RX−, GND, TX−, TX+, and GND of each third male connector 30 are respectively connected to the terminals GND, RX+, RX−, GND, TX−, TX+, and GND of a correspond first male connector 10.

In use, a motherboard (not shown) including a first female connector of a female SATA connector is connected to a corresponding first male connector 10. An HDD (not shown) is connected to a third corresponding male connector 30 if the HDD includes a second female connector of the female SATA connector, or the HDD is connected to the second male connector 20 if second female connector is a female SAS connector. Inversely, the motherboard can be connected to the second male connector 20 if the first female connector is the SAS female connector and the HDD can be connected to the first male connector 10 if the second female connector is the SATA female connector.

As described above, the cable connector 100 capable of connecting the motherboard and the HDD comprising the same type of female connectors or comprising different types of female connectors.

It will be understood that the above particular disclosures and methods are shown and described by way of illustration only. The principles and the features of the present disclosure may be employed in various and numerous disclosures thereof without departing from the scope of the disclosure as claimed. The above-described disclosures illustrate the scope of the disclosure but do not restrict the scope of the disclosure.

What is claimed is:

1. A cable connector, comprising:

four first SATA male connectors composing of a first input/output terminal;

a second SAS male connector; and four third SATA male connectors, the second SAS male connector and the third SATA male connectors composing of a second input/output terminal;

wherein each first SATA male connector is electrically connected to the second SAS male connector and a corresponding third SATA male connector.

2. The cable connector of claim 1, wherein the cable connector further comprises four first cables each of which comprises a first connection end and a second connection end, four second cables each of which comprises a third connection end and a fourth connection end, and four third cables each of which comprises a fifth connection end and a sixth connection end, each first connection end is electrically connected to a respective one of the four first SATA male connectors, each third connection end is connected to the second SAS male connector, each fourth connection end is connected to the second connection end of a respective one of the four first cables, each fifth connection end is connected to a respective one of the third SATA male connectors, each sixth connection end is connected to the second connection end of a respective one of the four first cables.

3. The cable connector of claim 2, wherein the cable connector further comprises a binding member for binding the first cables, the second cables, and the third cables together.

4. The cable connector of claim 2, wherein each first SATA male connector comprises seven terminals GND, RX+, RX−, GND, TX−, TX+, and GND, the second SAS male connector comprises thirty six terminals A1-A18 and B1-B18, the terminals GND, RX+, RX−, GND, TX−, TX+, and GND of a first one of the first SATA male connectors are respectively connected to the terminals B4, B2, B3, B1, A3, A2, and A1 of the second SAS male connector; the terminals GND, RX+, RX−, GND, TX−, TX+, and GND of a second one of the first SATA male connectors are respectively connected to the terminals B7, B5, B6, A7, A6, A5, and A4 of the second SAS male connector; the terminals GND, RX+, RX−, GND, TX−, TX+, and GND of a third one of the first SATA male connectors are respectively connected to the terminals B15, B13, B14, B12, A14, A13, and A12 of the second SAS male connector; the terminals GND, RX+, RX−, GND, TX−, TX+, and GND of a fourth one of the first SATA male connectors are respectively connected to the terminals B18, B16, B17, B18, A17, A16, and A15 of the second SAS male connector.

5. The cable connector of claim 4, wherein each third SATA male connector comprises seven terminals GND, RX+, RX−, GND, TX−, TX+, and GND, the seven terminals GND, RX+, RX−, GND, TX−, TX+, and GND of each third SATA male connector are respectively connected to the seven terminals GND, RX+, RX−, GND, TX−, TX+, and GND of a respective one of the first SATA male connectors.

6. A cable connector, comprising:

four first SATA male connectors of a first type composing of a first input/output terminal;

a second SAS male connector of a second type; and four third SATA male connectors of the first type, the second SAS male connector and the third SATA male connectors composing of a second input/output terminal;

wherein each first SATA male connector is electrically connected to the second SAS male connector and a corresponding one of the third SATA male connectors, the cable connector further comprises four first cables each of which comprises a first connection end and a second connection end, four second cables each of which comprises a third connection end and a fourth connection end, and four third cables each of which comprises a fifth connection end and a sixth connection end, each first connection end is electrically connected to a respective one of the first SATA male connectors, each third connection end is connected to the second SAS male connector, each fourth connection end is connected to the second connection end of a respective one of the four first cables, each fifth connection end is connected to a respective one of the third SATA male connectors, each sixth connection end is connected to the second connection end of a respective one of the four first cables.

7. The cable connector of claim 6, wherein the cable connector further comprises a binding member for binding the first cables, the second cables, and the third cables together.

8. The cable connector of claim 6, wherein each first SATA male connector comprises seven terminals GND, RX+, RX−, GND, TX−, TX+, and GND, the second SAS male connector comprises thirty six terminals A1-A18 and Bl-B18, the terminals GND, RX+, RX−, GND, TX−, TX+, and GND of a first one of the first SATA male connectors are respectively connected to the terminals B4, B2, B3, B1, A3, A2, and A1 of the second SAS male connector; the terminals GND, RX+, RX−, GND, TX−, TX+, and GND of a second one of the first SATA male connectors are respectively connected to the terminals B7, B5, B6, A7, A6, A5, and A4 of the second SAS male connector; the terminals GND, RX+, RX−, GND, TX−, TX+, and GND of a third one of the first SATA male connectors are respectively connected to the terminals B15, B13, B14, B12, A14, A13, and A12 of the second SAS male connector; the terminals GND, RX+, RX−, GND, TX−, TX+, and GND of a fourth one of the first SATA male connectors are respectively connected to the terminals B18, B16, B17, B18, A17, A16, and A15 of the second SAS male connector.

9. The cable connector of claim 8, wherein each third SATA male connector comprises seven terminals GND, RX+, RX−, GND, TX−, TX+, and GND, the seven terminals GND, RX+, RX−, GND, TX−, TX+, and GND of each third SATA male connector are respectively connected to the seven terminals GND, RX+, RX−, GND, TX−, TX+, and GND of a respective one of the first SATA male connectors.

* * * * *